US006502312B2

(12) United States Patent
Beutel et al.

(10) Patent No.: US 6,502,312 B2
(45) Date of Patent: Jan. 7, 2003

(54) POWER DRIVEN HAIR CLIPPER

(75) Inventors: Kurt Beutel, Flörsheim (DE); Wolfgang Franke, Langen (DE); Ludwig Hess, Bad Homburg (DE); Karl-Heinz Schadt, Schwalbach (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 09/884,666

(22) Filed: Jun. 19, 2001

(65) Prior Publication Data

US 2002/0000043 A1 Jan. 3, 2002

Related U.S. Application Data

(63) Continuation of application No. PCT/EP99/08524, filed on Nov. 6, 1999.

(30) Foreign Application Priority Data

Dec. 21, 1998 (DE) ..... 198 59 017

(51) Int. Cl.[7] ..... B26B 19/06
(52) U.S. Cl. ..... 30/216; 30/34.1
(58) Field of Search ..... 30/43.92, 527, 30/530, 531, 529, 43.6, 216, 199, 34.1

(56) References Cited

U.S. PATENT DOCUMENTS

| | | | | |
|---|---|---|---|---|
| 755,169 A | | 3/1904 | Priest | |
| 1,997,096 A | | 4/1935 | Andis | 30/199 |
| 2,300,143 A | * | 10/1942 | Berg | 30/34.1 |
| 2,485,787 A | | 10/1949 | Sutch | 30/197 |
| 2,741,026 A | | 4/1956 | Guenther | 30/210 |
| 3,279,056 A | | 10/1966 | Andis | 30/34.1 |
| 4,581,822 A | | 4/1986 | Fujimura | 30/216 |
| 5,054,199 A | | 10/1991 | Ogawa et al. | 30/34.1 |
| 5,579,581 A | | 12/1996 | Melton | 30/223 |

FOREIGN PATENT DOCUMENTS

| | | | |
|---|---|---|---|
| DE | 23 43 116 | 8/1973 | B26B/19/10 |
| DE | 26 46 818 | 5/1977 | B26B/19/02 |
| DE | 40 39 681 | 7/1991 | B26B/19/02 |
| FR | 1 099 084 | 8/1955 | B26B/19/06 |
| GB | 2 294 230 | 4/1996 | B26B/19/06 |
| JP | 63-158093 | 7/1988 | B26B/19/26 |
| WO | WO 98/47673 | 10/1998 | B26B/19/06 |
| XH | DM/043 496 | 11/1997 | 28/3 |

OTHER PUBLICATIONS

PCT Int'l Search Report in corresponding application PCT/EP99/08524, dated Feb. 24, 2000.

Co–pending application, co–filed (same date), co–assigned U.S. Ser. No. Unknown, entitled "Power Driven Hair Clipper", Atty. Dkt. No. B–60345, naming inventors Kurt Beutel and Wolfgang Franke.

* cited by examiner

*Primary Examiner*—Douglas D. Watts
(74) *Attorney, Agent, or Firm*—Edward S. Podszus

(57) ABSTRACT

The invention is directed to a power driven hair clipper (HSM), comprising a drive mechanism provided in a housing (1) and a clipper head (S) equipped with a clipper comb (3) and a clipper blade (4, 82) and mounted on said housing (1) for pivotal motion about a pivot axis (Z), wherein the clipper comb (3) is in cooperating relationship with two clipper blades (4, 82), each being adapted to be coupled with a drive member (12) of the drive mechanism according to the pivot position of the clipper head (S) relative to the housing (1).

55 Claims, 9 Drawing Sheets

Fig. 13
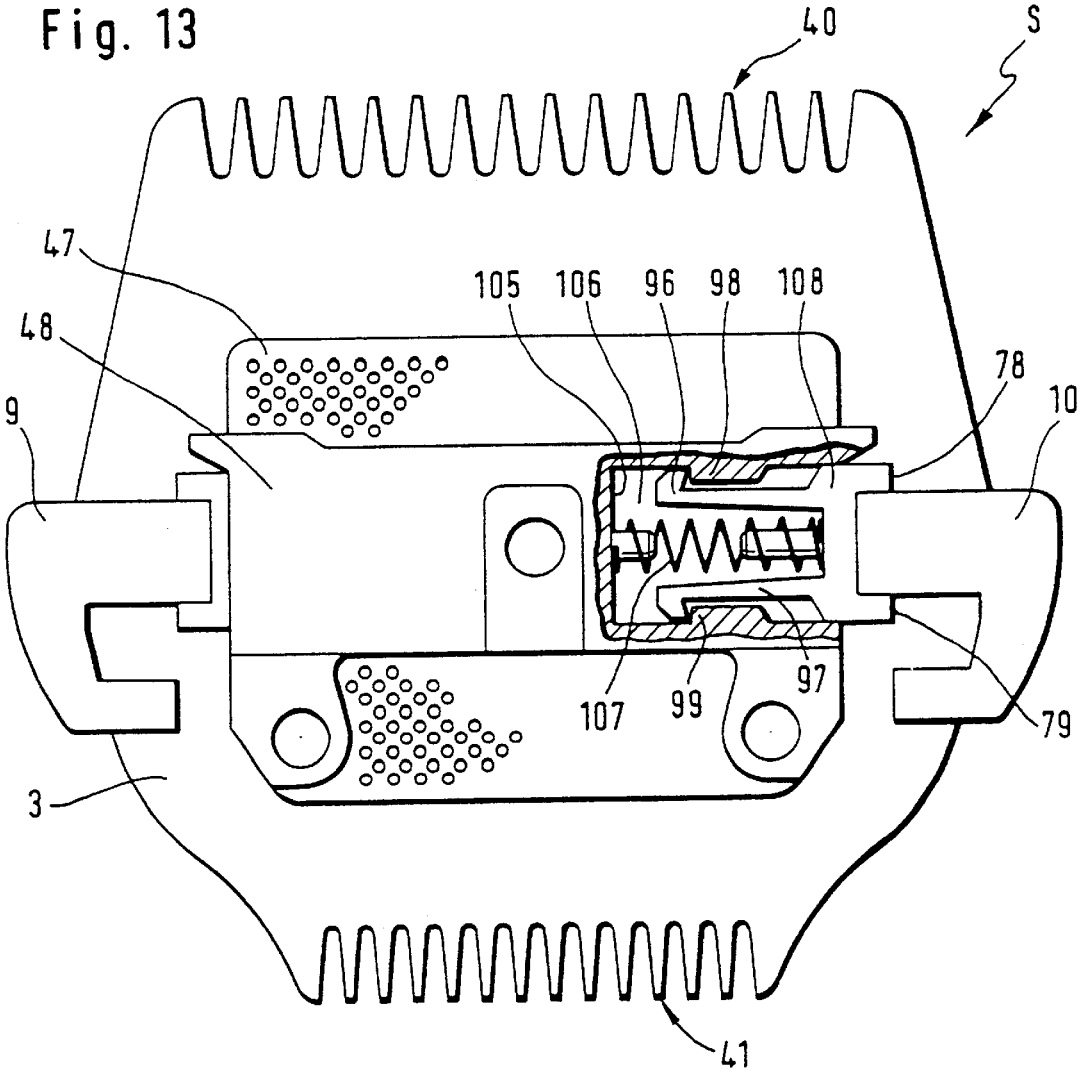
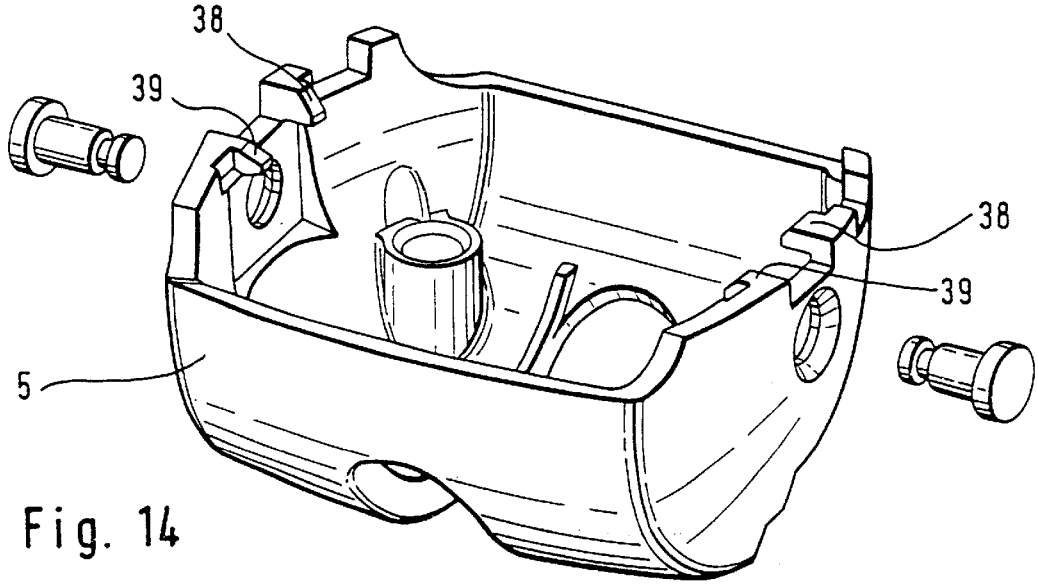
Fig. 14

POWER DRIVEN HAIR CLIPPER

This is a continuation of International Application PCT/EP99/08524, pending, with an International filing date of Nov. 6, 1999.

FIELD OF THE INVENTION

This invention relates to a power driven hair clipper.

BACKGROUND

A power driven hair clipper of the type initially referred to is known from U.S. Pat. No. 1,997,096, having a cutter head mounted for pivotal motion into corresponding positions for shaving and trimming, comprising a supporting element mounted for controlled pivotal motion along a curved track, a comb plate with only one row of teeth, and a cutter blade held in engagement with the comb plate by means of a resilient tension plate resting on the supporting element. An actuating element extending from the upper end of the casing transmits the driving motion to the cutter blade. A friction element acted upon by a spring element is arranged in the supporting element in such a way that it is urged against the upper surface of the hair clipper's casing in order to hold the cutter head in any given pivot position by frictional pressure engagement. For the cutter head to be displaceable from its position of adjustment, the predetermined frictional force has to be overcome. This can lead during clipper operation to undesirable changes of position, especially since frictional forces tend to decrease in the course of using the hair clipper.

A power driven hair clipper of the type initially referred to is further known from U.S. Pat. No. 2,741,026. The cutting head, formed by an outer blade and an inner cutting blade driven to oscillate, is rigidly fastened to the yoke arms of the casing head constructed in a U-shaped configuration. The arcuate shape of the outer blade with its two rows of cutting teeth permits the hair clipper and the outer blade fastened thereto to execute a restricted pivot movement of 9°, while the relatively large distance of the cutting head's row of teeth used at a time to the biggest diameter of the hair clipper's casing is intended to enable both rows of teeth to be used for trimming purposes.

From GB-A-2 294 230 there is known a power driven hair clipper with a cutter head mounted for pivotal motion in all directions, whose pivotability is assured by a ball and socket connection between the housing and the cutter head. The cutter head, comprised of a supporting element and a housing cover member, includes a pair of blades, each equipped with two rows of cutting teeth extending parallel to each other but arranged in the cutter head in such a way that only one of the cooperating rows of cutting teeth on the pair of blades projects out of the cutter head housing. For the second row of cutting teeth to be brought into use, the cutter head has to be opened to enable the pair of blades to be turned through 180° inside the cutter head.

From PCT-WO 98/47673 there is known a clipper head for a power driven hair clipper, comprising a supporting element, a clipper comb fastened thereto, and a clipper blade urged into engagement with the clipper comb via a driving element arranged to oscillate, under the action of a spring element bearing against the supporting element. A coupling element for transmitting the movement from the drive mechanism of the hair clipper to the clipper blade is provided on the driving element. To reduce the friction between the clipper comb and the clipper blade provision is made between the ends of the clipper comb and the clipper blade on the side remote from the row of cutting teeth for a component made of a material displaying reduced friction properties. For cleaning and replacement purposes, the supporting element of the clipper head is attachable to the housing by means of a clip connection.

SUMMARY OF THE INVENTION

It is an object of the present invention to improve a power driven hair clipper of the type initially referred to in respect of its function and handling.

According to the invention this object is accomplished with a power driven hair clipper of the type initially referred to in that the clipper comb is in cooperating relationship with two clipper blades, each being adapted to be coupled with a drive member of the drive mechanism according to the pivot position of the clipper head relative to the housing. This invention has numerous advantages. One advantage is that, using a pivotal motion, the clipper head with its two rows of cutting teeth can be brought into an optimal cutting position relative to a skin surface and that, in such a pivot position, only one of the two clipper blades associated with the clipper comb is coupled with the drive member of an electric drive mechanism provided in the housing. This results in a reduction of power consumption because only that clipper blade intended to be used at any one time is driven to cooperate with the clipper comb. The cooperative relationship of two clipper blades with one clipper comb advantageously enables the rows of teeth of the clipper comb and the rows of teeth of the two clipper blades to be differently constructed, for example by having the width of one row of cutting teeth significantly smaller than the width of the other row of cutting teeth. Furthermore, it is also possible for the contour of one row of cutting teeth to be straight, for example, as opposed to an arcuate contour of the second row of cutting teeth opposite. Different constructions of this type enlarge the hair clipper's scope of use.

According to a preferred embodiment of the invention the clipper head is securable to a supporting element mounted on the housing for pivotal motion about the pivot axis. This arrangement guarantees that the clipper head can be easily and quickly coupled to and uncoupled from the pivotable supporting element of the hair clipper, thus making it possible to exchange clipper heads, to clean detached clipper heads and to replace clipper heads.

In a further aspect of the invention the supporting element is constructed as a housing shell. The housing shell advantageously surrounds the components of the clipper head fastened to the clipper comb, providing protection from damage.

One embodiment of the invention is characterized in that the housing shell is pivotally mounted on two opposing side walls of the housing. According to the invention one end of the housing is preferably constructed in a U-shaped yoke configuration, with the housing shell being pivotally mounted on the yoke arms of the housing by means of pivot bearings.

According to a preferred embodiment of the invention the it pivot bearings are formed by cooperating conical bearing elements. The cooperation of the conical bearing elements forming a conical bearing is promoted by having a bearing pin pass through the conical bearing. Optimal cooperation between the conical bearing elements and the bearing pin is guaranteed in that the bearing pin is movable against the pressure of at least one spring element.

According to yet another embodiment of the invention the clipper head is releasably attached to the supporting element by means of a locking device. Actuation of the locking device en25 sures easy and fast removal of the clipper head from the supporting element.

In a further embodiment of the invention a chassis is fastened to the clipper comb with its two rows of cutting teeth. In a further aspect of this embodiment provision is made for the chassis to act as the carrier of components of the locking device. In yet another aspect of this embodiment of the invention the chassis is provided with at least one locking device having a latching element movable against the pressure of a spring element. Preferably at least one latching element for the locking device is arranged on the supporting element.

A preferred embodiment of the invention is characterized in that the pivot range of the clipper head is limitable by stops. Preferably these stops are formed by wall elements.

According to a further advantageous embodiment of the invention the pivot range of the clipper head is locatable by means of a detent device. The detent device is preferably formed by at least one notch and one detent element adapted to be acted upon by a spring element.

According to yet another embodiment of the invention the spring element and the detent element are provided in the housing, and the notch is provided on an outer wall of the supporting element.

In a preferred embodiment the clipper head with the housing shell of the supporting element is pivotally mounted inside a housing head shell of the housing on the wall of the housing head shell. In a further aspect of this embodiment the directions of extension of the wall of the housing on either side of the pivot bearings are each aligned parallel to a maximal pivot angle of the clipper head. According to one embodiment of the invention the pivot angles of the clipper head are constructed to be of equal size. According to another embodiment of the invention the pivot angles of the clipper head are constructed to be of different size.

According to yet another embodiment of the invention the chassis is arranged on a foil resting on the clipper comb. According to a particularly advantageous embodiment of the invention the end of the clipper blade on the side remote from a row of cutting teeth is slidably held on the foil. To reduce the friction of the clipper blade on the foil provision is made in one embodiment of the invention for the foil to have a perforation. According to the invention the friction is further reduced by using the perforation as a receptacle for a lubricant. According to an embodiment of the invention the perforation is formed by holes. In another embodiment of the invention the perforation is formed by flanges.

An embodiment of the present invention will be described in the following with reference to the accompanying drawings.

BRIEF DESCRIPTION OF THE DRAWINGS

FIG. 13 is a side view of the clipper comb with the chassis attached thereto and a foil, part of the chassis being broken away to expose components of the locking device; and FIG. 14 is a perspective view of the supporting element showing latching elements.

DETAILED DESCRIPTION OF PREFERRED EMBODIMENTS

Figure 1:
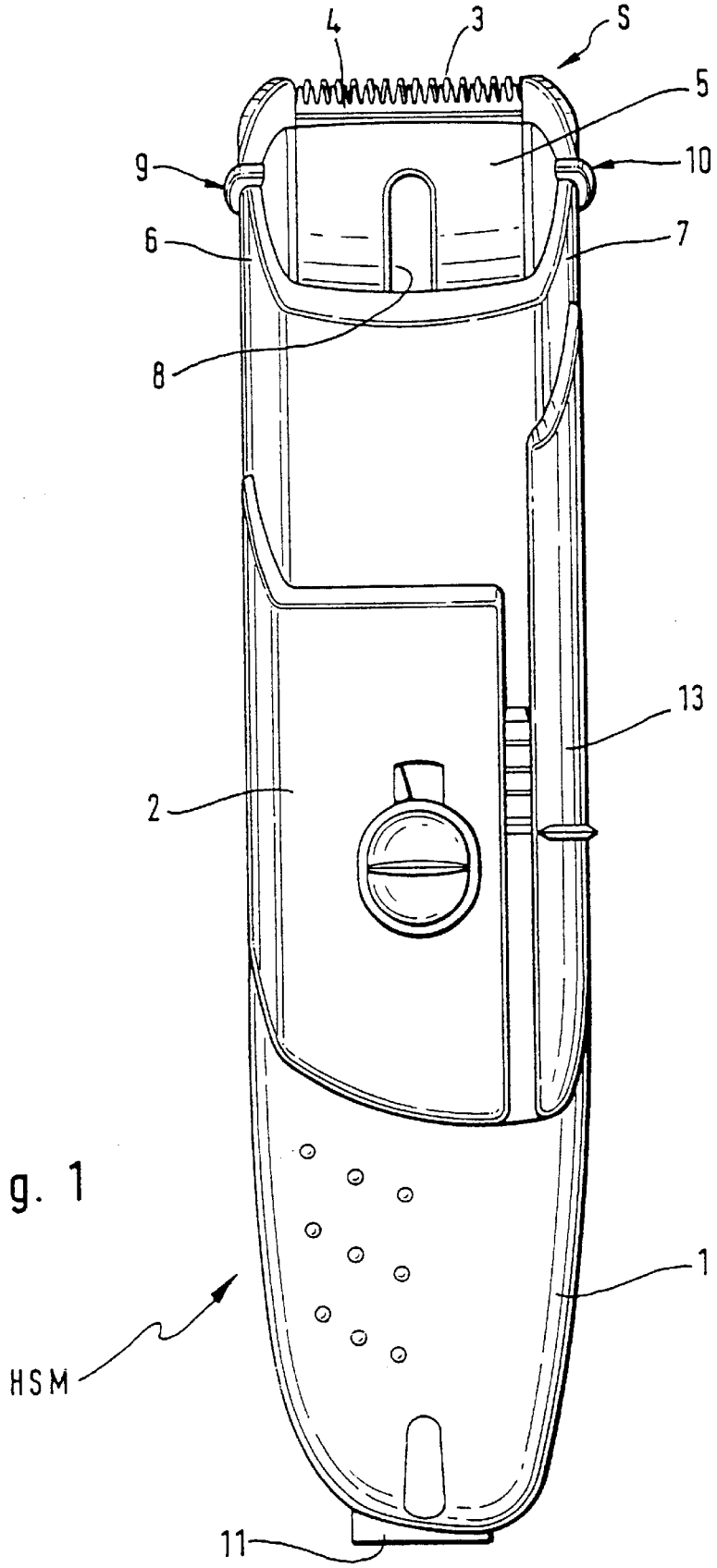
FIG. 1 is a front view of a power driven hair clipper having an actuating switch movable into various positions and a position switch.
Figure 2:
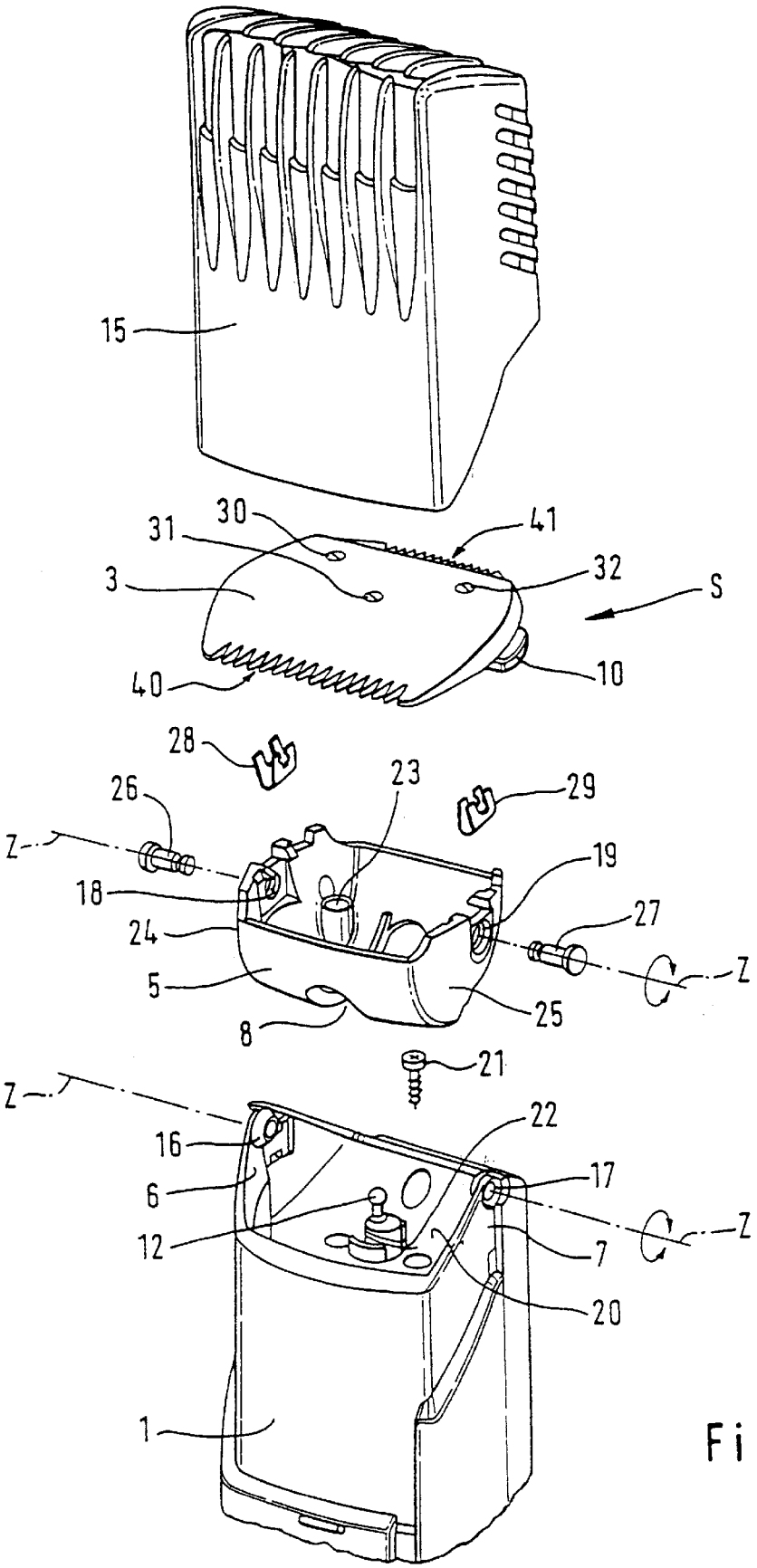
FIG. 2 is an exploded view of the upper part of a power driven hair clipper comprising a detached supporting element, a clipper head having two rows of cutting teeth, and a distancing comb seatable onto the housing.

FIG. 1 shows the front view of a power driven hair clipper HSM with an actuating switch 2 adjustably arranged on the front panel of the housing 1, a position switch 13 and a clipper head S which has a clipper comb 3 and a clipper blade 4 and is mounted on the housing 1 for pivotal motion about a pivot axis Z—see FIG. 2. For this purpose one end of the housing 1 is of a U-shaped yoke configuration so that a supporting element 5 constructed as a housing shell and carrying the clipper head S is adapted to be pivotally mounted by means of pivot bearings on the yoke arms 6 and 7. In the cylindrically shaped wall of the supporting element 5 provision is made for a cutout 8 to couple a drive member 12—see FIG. 2—of an electric drive mechanism provided in the housing 1 with a drivable clipper blade 4 according to the pivot position of the clipper head S relative to the housing 1. The clipper head S is releasably attached to the supporting element 5 by means of a locking device 9, 10. At the end of the housing 1 remote from the clipper head S provision is made for an appliance socket 11 for the indirect and/or direct operation of the hair clipper HSM.

FIG. 2 is an exploded view of the upper part of a power driven hair clipper HSM showing the supporting element 5, the clipper head S attachable thereto and a distancing comb 15 detached from the housing 1. The upper end of the housing 1 is of a yoke-type construction, with conical bearing elements 16 and 17 being integrally formed on the yoke arms 6 and 7 in order to provide a pivot bearing in conjunction with the conical bearing elements 18 and 19 of the supporting element 5. Between the two yoke arms 6 and 7 a housing head shell 20 is fastened to the housing 1 by means of fastening elements 21. In the middle of the housing shell provision is made for an opening 22 through which the drive member 12 of an electric drive mechanism accommodated in the housing 1 extends.

Figure 8:
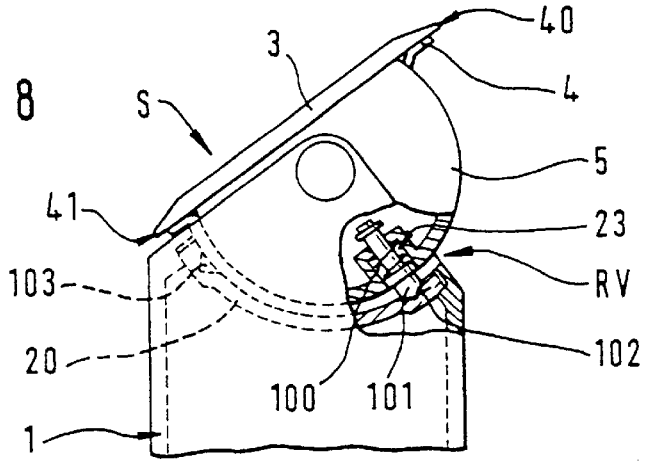
FIG. 8 is a view of part of a housing, showing stops on the housing for abutting engagement with the pivoted clipper head and components of a detent device for the clipper head.
Figure 9:
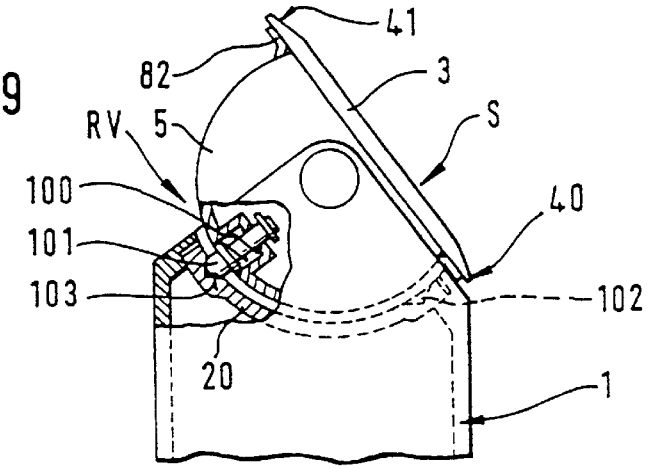
FIG. 9 is a view of part of a housing, showing stops on the housing for abutting engagement with the pivoted clipper head and components of a detent device for the clipper head.
Figure 10:
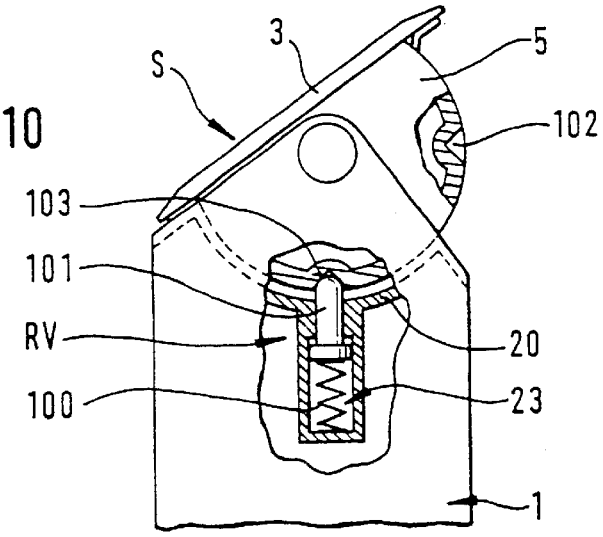
FIG. 10 is a view of part of a housing, showing stops on the housing for abutting engagement with the pivoted clipper head and components of a detent device for the clipper head.

The supporting element 5 is comprised essentially of a trough-shaped housing shell having a cutout 8 for passage of the electric drive member 12, and of an integrally formed chamber 23 for accommodating the components of a detent device RV—see FIG. 8 to FIG. 10. The conical bearing elements 18 and 19 are provided in opposite end walls 24 and 25 of the supporting element 5. The supporting element 5 is held for pivotal motion about the pivot axis Z by means of bearing pins 26 and 27 and spring elements 28 and 29 and the conical bearing elements 16 and 17 as well as 18 and 19.

The clipper head S is releasably attached to the supporting element 5 by means of at least one locking device 9, 10—see FIGS. 1, 11, 13, 14. The clipper comb 3 of the clipper head S has two rows of cutting teeth 40, 41 arranged opposite each other along the longitudinal sides of the clipper comb 3. The row of cutting teeth 41 extends to a smaller width than the row of cutting teeth 40. The heads of the illustrated fastening screws 30, 31 and 32 serve to fasten components of the clipper head S—in this connection see FIG. 3.

Figure 3:
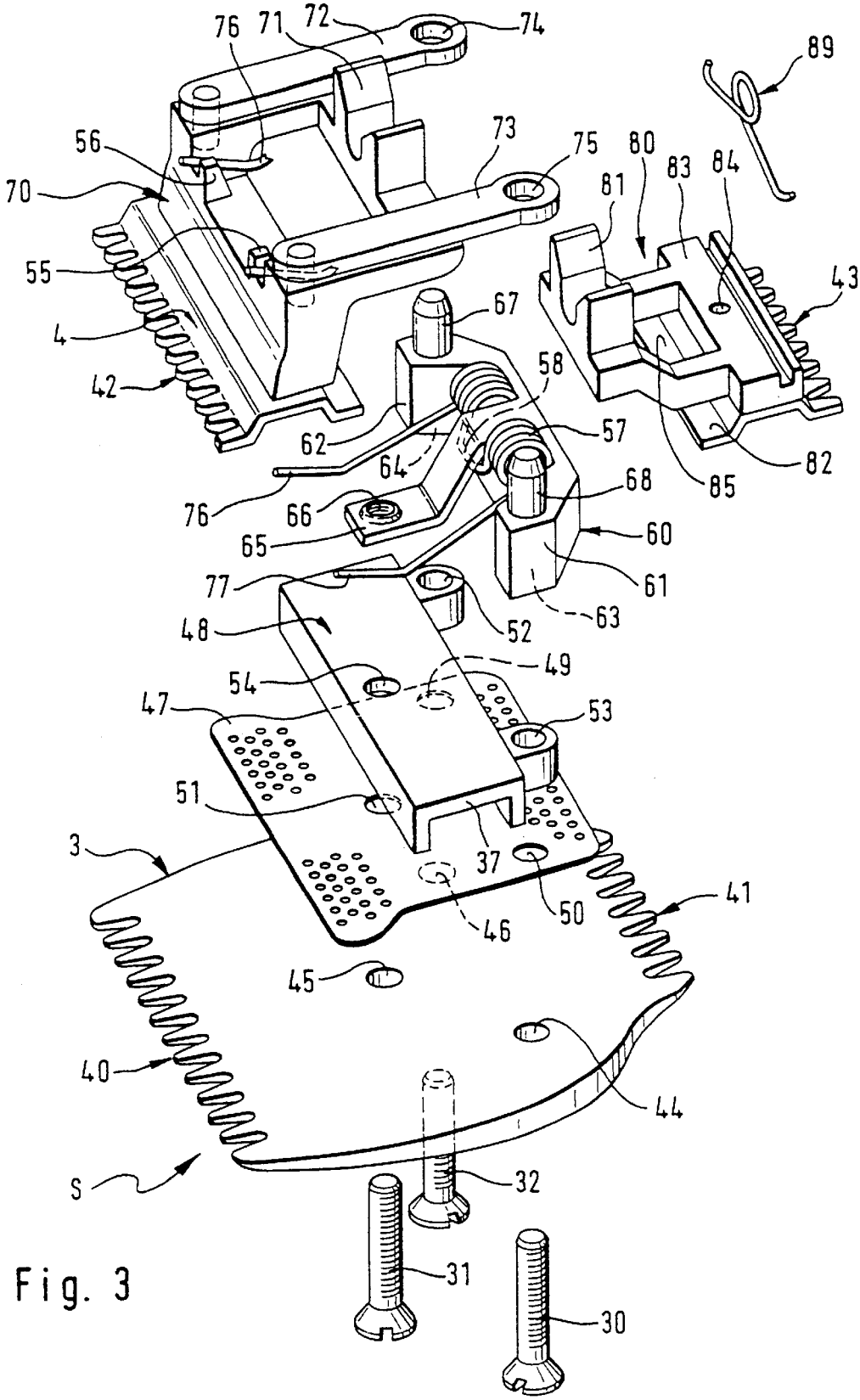
FIG. 3 is an exploded view of the components of a clipper head.

FIG. 3 shows an exploded view of the clipper head S with a perspective view of the provided components. Two rows of cutting teeth 40 and 41 disposed in the opposing longitudinal sides of the clipper comb 3 are provided on the clipper comb 3. The clipper comb 3 has three through-holes 44, 45 and 46 for passage of the fastening screws 30, 31 and 32. Disposed on the inside of the clipper comb 3 is first a foil 47 with the through-holes 49, 50, 51 and then a chassis 48 with the through-holes 52, 53 and 54. The relatively thin foil 47 has a plurality of small holes with or without flanges or beads to receive a lubricant. The chassis 48 is of a U-shaped configuration in order to receive a locking device 9, 10 described in more detail with reference to FIGS. 10 and 11. The through-hole 54 is provided in the cross wall 37 of the U-shape joining the two longitudinal walls, whereas the through-holes 52 and 53 are provided in two lugs integrally formed on one of the longitudinal sides of the chassis 48. A bearing bracket 60 with two bracket arms 61 and 62 is associated with the chassis 48. Female threads 63 and 64 are provided in the bracket arms 61 and 62 in order to fasten to the clipper comb 3 the bearing bracket 60 and the chassis 48 by way of the through-holes 52 and 53, and the foil 47 by way of the through-holes 49 and 50, using the fastening screws 30 and 32 passing through the through-holes 46 and 44. The bearing bracket 60 is additionally secured to the clipper comb 3 via a fastening arm 65 having a tapped hole 66 for threaded engagement with a fastening screw 31 passing through the through-hole 45 of the clipper comb 3, the through-hole 51 of the foil 47 and the through-hole 54 of the chassis 48.

On the side of the bearing bracket 60 remote from the clipper comb 3 provision is made for two bearing trunnions 67, 68 for pivotally mounting a driving element 70. Fastened to the driving element 70 is a clipper blade 4 comprising a row of cutting teeth 42. In addition to this, provision is made on the driving element for a coupling element 71 and two oscillating levers 72 and 73 pivotally mounting the driving element 70 by engagement of the bearing trunnions 67 and 68 of the bearing bracket 60 with the bearing bores 74 and 75. The oscillating levers 72 and 73 are pivotally mounted on the driving element 70 by their ends opposite the bearing bores 74 and 75, for example by way of pivot bearings comprised of bearing trunnions and bearing bores. Instead of pivot bearings comprised of bearing trunnions and bearing bores it is also possible to use, for example, film hinge joints as pivot bearings.

Figure 3A:
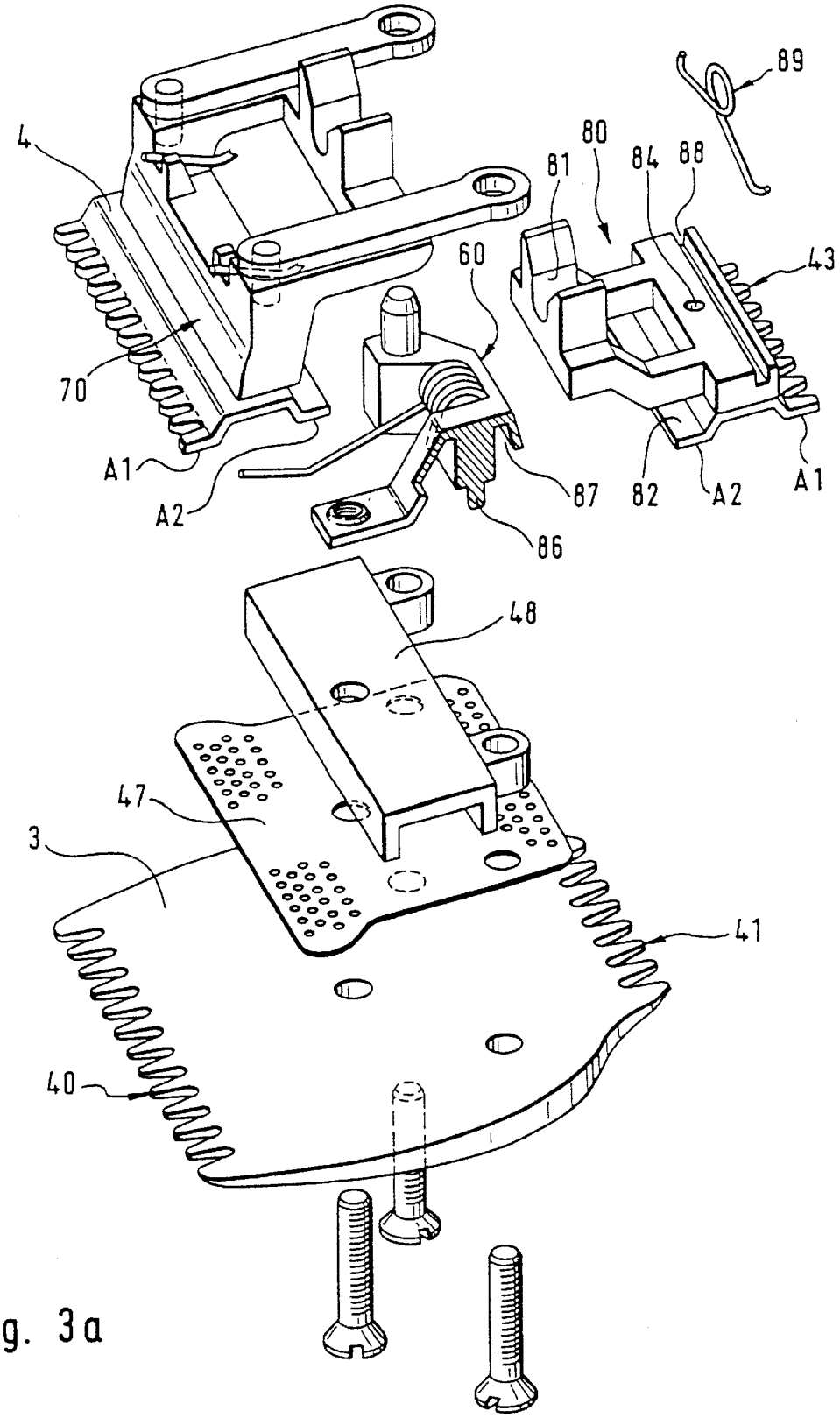
FIG. 3*a* is an exploded view of the components of the clipper head of FIG. 3, including additionally a sectional view of the bearing bracket.

The clipper blade 4 fastened to the driving element 70 has on its side close to the inside of the clipper comb 3*a* groove-like recess, whereby two engagement surfaces A1, A2 are produced—see FIG. 3*a*—in order to reduce the area making sliding contact with the inside of the clipper comb 3. In the assembled state the row of cutting teeth 42 of the clipper blade 4 makes engagement with the row of cutting teeth 40 of the clipper comb 3, while the end of the clipper blade 4 opposite the row of cutting teeth 42 makes engagement with the foil 47 in order to slide to and fro on the foil 47 during operation of the clipper blade 4. To minimize friction occurring in the process between the relatively narrow projecting area of the clipper blade 4 and the foil 47, a lubricant is stored either in the holes of the foil 47 or in recesses formed by flanges surrounding the holes. The sliding bearing of the clipper blade 4 against the relatively narrow area of engagement with the foil 47 results in a slight inclination of the clipper blade 4 on the planar inside of the clipper comb 3 relative to the rows of cutting teeth 40 and 42, thereby effecting an optimal cooperation between the row of cutting teeth 40 of the clipper comb 3 and the row of cutting teeth 42 of the clipper blade 4 for the cutting of hair.

Integrally formed on the driving element 70 are two yoke arms 55 and 56 for receiving the spring arms 76, 77 of a spring element 57 fastened to the bearing bracket 60 by means of a spring arm 58 reaching under the fastening arm 65. The necessary contact pressure to effect cooperation of the clipper comb 3 with the clipper blade 4 is exerted on the clipper blade 4 by means of the spring arms 76 and 77 of the spring element 57 acting via the yoke arms 55 and 56 of the driving element 70.

On a driving element 80 provision is made for a coupling element 81 to operate the clipper blade 82 which has a row of cutting teeth 43 and is fastened to the driving element 80, and on a longitudinal web portion 83 of the driving element 80 provision is made for a bearing bore 84 for pivotally mounting the driving element 80 and the clipper blade 82. Between the bearing bore 84 and the coupling element 81 provision is made for an opening 85 through which, in the assembled state of the bearing bracket 60 and the driving element 80, the fastening arm 65 of the bearing bracket 60 is passed. In the assembled state of the clipper head S the coupling element 81 is provided adjacent to the coupling element 71.

Details of the pivotable bearing of the driving element 80 with the clipper blade 82 are shown in FIG. 3*a* and are described in more detail below. In contrast to FIG. 3, the presentation of the bearing bracket 60 of FIG. 3*a* shows a section through the middle of the bar extending in longitudinal direction, thereby providing a clear view of the bearing trunnion 86 required for the pivotal motion of the driving element 80, and a spring chamber 87. With the driving element 80 in the assembled state the bearing trunnion 86 engages in the bearing bore 84 in order to set the driving element 80 with the attached clipper blade 82 in a reciprocating pivotal motion when the coupling element 81 is coupled with the drive member 12—see FIG. 2. The necessary contact pressure of the row of cutting teeth 43 of the clipper blade 82 is exerted on the row of cutting teeth 41 of the clipper comb 3 by means of a spring element 89 seated in the spring chamber 87 in addition to having its spring legs seated in the groove-shaped spring seat 88 provided in the web portion of the driving element 80.

Like the clipper blade 4, the clipper blade 82 has a groove-like recess, thus forming two engagement surfaces A1, A2 with the clipper comb 3, whereby in the assembled state of the clipper head S the engagement surface A2 of the clipper blade 82 extending opposite to the row of cutting teeth 43 comes into sliding contact with the foil 47. The relatively narrow engagement surface A2 of the clipper blade 82 results, upon engagement with the foil 47, in a slight inclination of the clipper blade 82 relative to the row of cutting teeth 43 of the clipper comb 3, thus effecting an optimal cooperation of the row of cutting teeth 43 of the clipper blade 82 with the row of cutting teeth 41 of the clipper comb 3 for cutting hair. This arrangement leads to a reduction in size of cooperating friction surfaces, the overall friction being significantly reduced by the holes in the foil 47 or by grooves formed in the foil by means of flanges or bars. A further reduction of friction is achieved by disposing a lubricant in either the holes or grooves or recesses in the foil 47.

Figure 4:
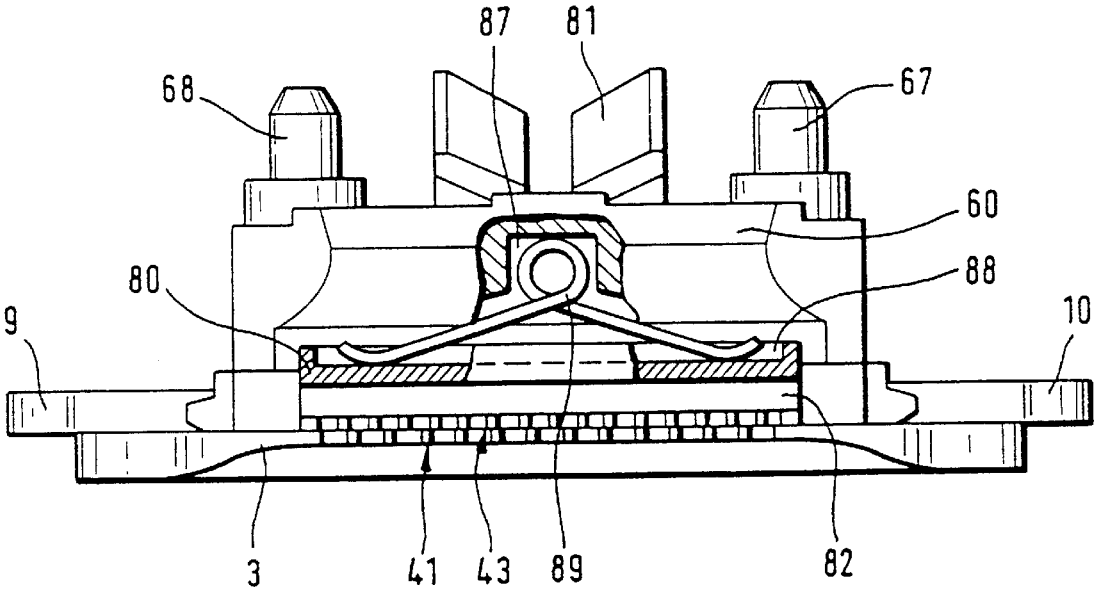
FIG. 4 is a side view of the clipper head, showing the clipper blade and a coupling element.
Figure 5:
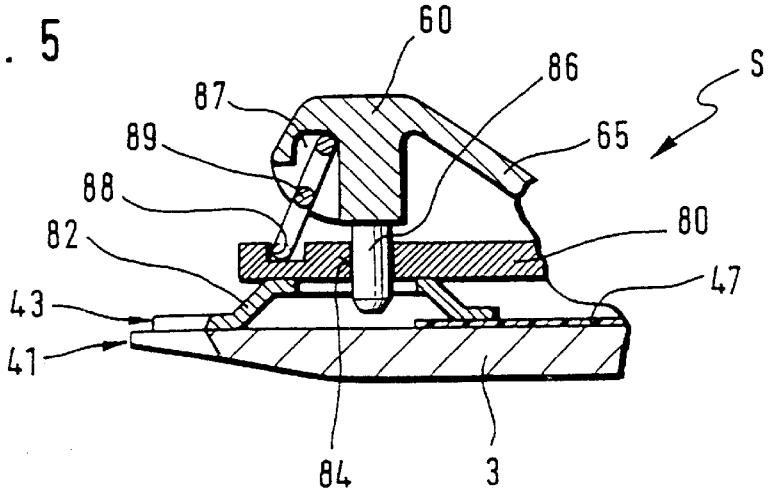
FIG. 5 is a cross-sectional view of the middle of the bearing bracket, the driving element, the clipper blades and the clipper comb.

FIGS. 4 and 5 show further details of the arrangement of the spring element 89 in the spring chamber 87 and the spring seat 88 constructed as a groove. FIG. 4 shows a view of the cutting teeth of the clipper comb 3 and the clipper blade 82 as well as the bearing bracket 60, in whose spring chamber 87 a spring element 89 configured as a leg spring is received and captured. The two legs of the leg spring extend into the groove of the spring seat 88, urging the clipper blade 82, by way of the driving element 80, against the row of cutting teeth 41 of the clipper comb 3. The coupling element 81 is arranged between the two bearing trunnions 67 and 68 and capable of reciprocating.

FIG. 5 shows a cross section through the middle of the bearing bracket 60, the driving element 80, the clipper blade 82 and the clipper comb 3 of the clipper head S. The cross section also shows the engagement of the spring element 89 with a wall of the spring chamber 87 and, in addition, with a wall of the groove-shaped spring seat 88 provided in the driving element 80. The contact pressure of the spring element 89 operates to hold the clipper blade 82 with its row of cutting teeth 43 in engagement with the row of cutting teeth 41 of the clipper comb 3, in addition to causing the opposite narrow area of the clipper blade 82 to be maintained in engagement with the foil 47 resting on the clipper comb 3. The clipper blade 82 with the driving element 80 is pivotally mounted on the bearing bracket 60 by means of the bearing trunnion 86 provided on the bearing bracket 60, and the coupling element 81 provided on the driving element 80—see FIG. 4—transmits the driving motion from the drive mechanism of the power driven hair clipper HSM to the clipper blade 82. The bearing bracket 60 is fastened by means of a fastening arm 65—in this connection see FIG. 3*a*—to the clipper comb 3 by means of a fastening screw 31.

Figure 6:
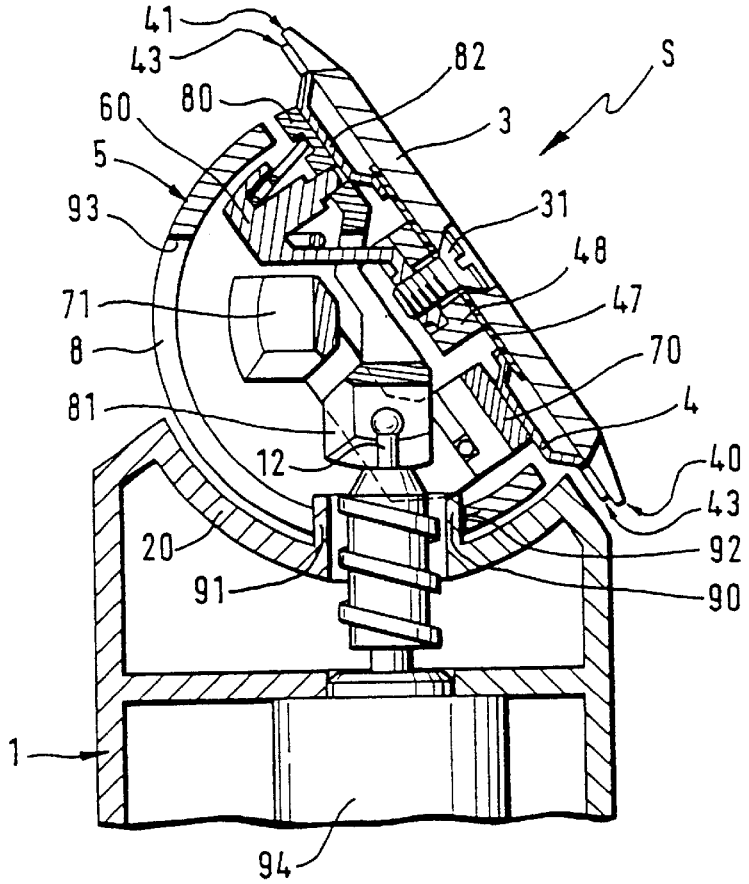
FIG. 6 is a longitudinal sectional view of the upper part of the housing, showing a clipper head in abutment with a stop on the housing, and a row of cutting teeth in the position of use.
Figure 7:
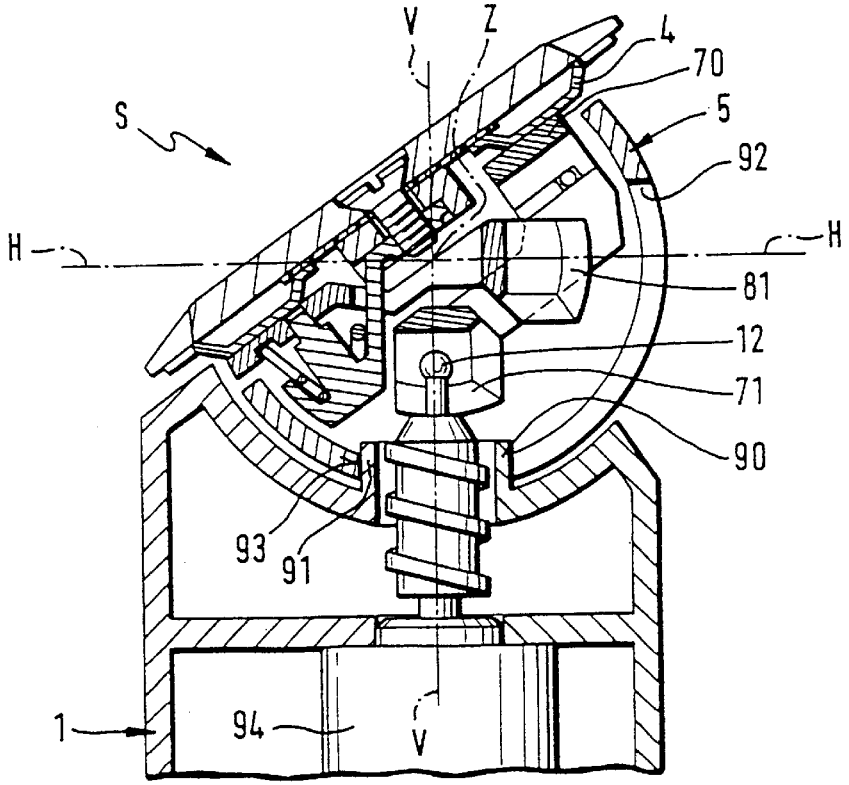
FIG. 7 is a longitudinal sectional view of the upper part of the housing, showing a clipper head in abutment with a stop on the housing, and respective rows of cutting teeth of the clipper comb and the clipper blade in the position of use.

FIGS. 6 and 7 show a cross section through the middle of the clipper head S and the upper part of the housing 1, from which it will be seen that the respective position of the clipper head S and hence of the cutting system being put to use, comprised of a clipper comb 3 and clipper blades 4 and 82, is defined by stops which are formed, for example, by wall elements 90 and 91 of the housing 1 and by wall elements 92 and 93 of the supporting element 5. The wall elements 92 and 93 are formed, for example, by means of an elongate cutout 8 provided in the housing shell of the supporting element 5. Arranged in the housing 1 is an electric motor 94 whose drive member 12, configured as an eccentric, engages in the coupling element 81 in order to drive the cutting system, which is in operating position, of the clipper head S comprised of the clipper comb 3 and the clipper blade 82. The coupling element 71 provided to drive the clipper blade 4 is disengaged from the drive member 12. The operating position of the row of cutting teeth 43 of the clipper blade 82 cooperating with the row of cutting teeth 41 of the clipper comb 3 is defined according to FIG. 6 by abutment of the wall element 92 of the supporting element 5 with the wall element 90 of the housing head shell 20 of the housing 1. In the embodiment of FIG. 6 the bearing bracket 60 and the chassis 48 and the foil 47 are fastened to the planar inner surface of the clipper comb 3 by means of the fastening screw 31. The clipper blade 4 fastened to the driving element 70 and the clipper blade 82 fastened to the driving element 80 bear with their longitudinally extending engagement surfaces A2, A1 against the foil 47 and, on account of the thickness of the foil 47, adopt a slight inclination toward their rows of cutting teeth 42 and 43, respectively.

In contrast to the representation of FIG. 6, the clipper head S in the embodiment of FIG. 7 is pivoted by a predetermined angle relative to a vertical axis V and a horizontal axis H about the pivot axis Z, whereby the wall element 93 comes to rest against the wall element 91. In this position of the clipper head S the drive member 12, constructed as an eccentric, of the electric motor 94 is coupled with the coupling element 71, causing the driving motion of the electric motor 94 to be transmitted in the activated state via the provided driving element 70 to the clipper blade 4 so that the clipper head S, then in operating position, can be used to cut hair.

FIGS. 8, 9 and 10 show detent devices RV enabling the clipper head S to be maintained in various operating positions, particularly at an optimal angle of application to the skin. FIG. 8 shows the upper part of a housing 1 with a pivotally mounted supporting element 5 which is coupled to a clipper head S. A chamber 23 for receiving a spring element 100 and a detent element 101 is provided in the supporting element 5 constructed as a housing shell. In the housing head shell 20 of the housing 1 provision is made for at least two notches 102 for receiving the detent element 101 and hence for locating the clipper head S in its pivot position. In the embodiment of FIG. 8 the detent element 101 is in engagement with the notch 102, thereby defining the operating position of the clipper blade 4 with the cooperating row of cutting teeth 40. In the embodiment of FIG. 9 the detent element 101 is in engagement with the notch 103 provided in the housing head shell 20, thereby defining the operating position of the clipper blade 82 with the row of cutting teeth 41 of the clipper comb 3. In the embodiment of FIG. 10 the chamber 23, the spring element 100 and the detent element 101 are provided in the housing 1, the detent element 101 extending through the wall of the housing head shell 20 and projecting into a notch 103 provided in the housing shell of the supporting element 5 in order to arrest the clipper head S in one of the provided operating positions. A further operating position is provided by the notch 102 in the outer wall of the housing shell of the supporting element 5.

Figure 11:
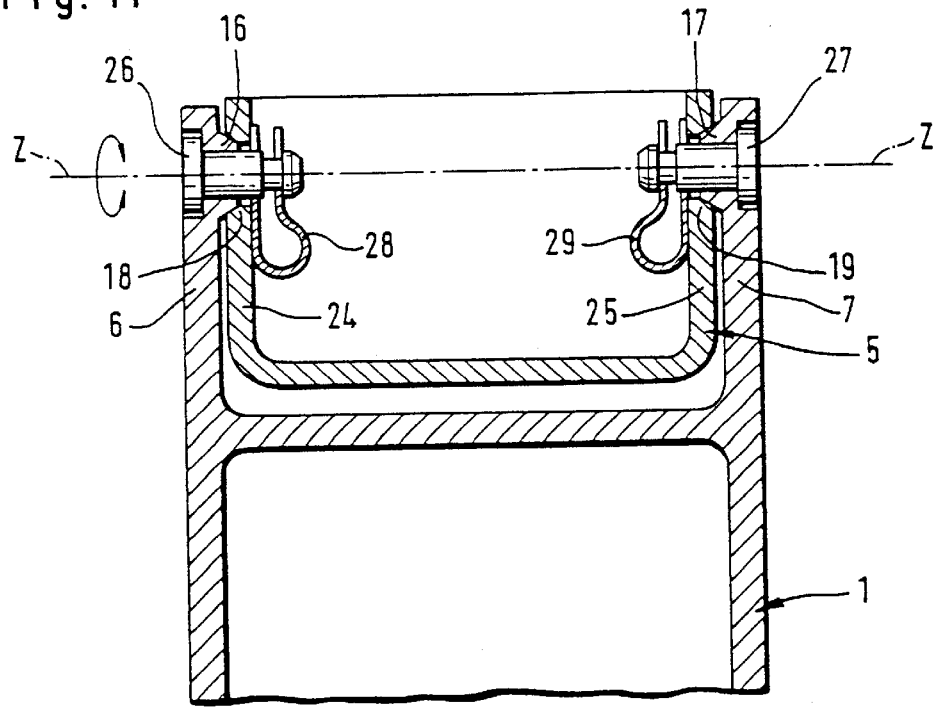
FIG. 11 is a longitudinal sectional view of the housing and the yoke arms provided thereon as well as of the supporting element in the area of the pivot bearings.
Figure 12:
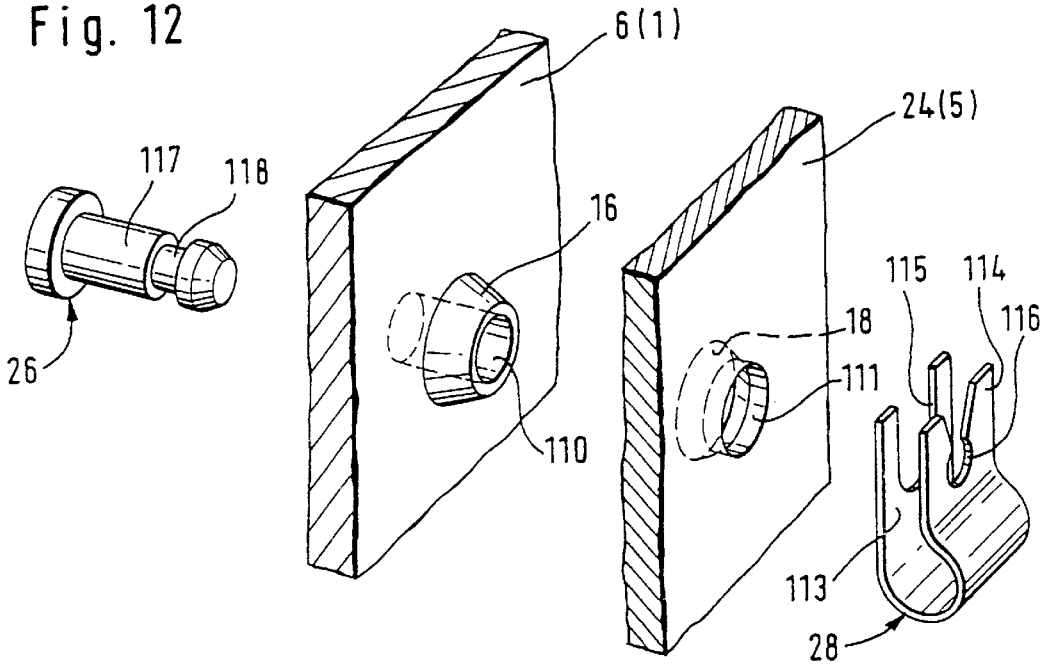
FIG. 12 is a view of details of a pivot bearing constructed in accordance with the embodiment of FIG. 11.

FIGS. 11 and 12 show details of the bearing structure of the supporting element 5 on wall elements of the housing 1, which are described below in more detail. The supporting element 5 with its end walls 24 and 25 is arranged between the yoke arms 6 and 7 of the housing 1 and pivotally mounted about the pivot axis Z by means of two pivot bearings. The two pivot bearings are identically constructed, comprising respectively a bearing pin 26, 27, a spring element 28, 29 and conical bearing elements 16, 18 and 17, 19. Details of the bearing structure are shown in FIG. 12 in an exploded view and are described below in more detail. The bearing pin 26 includes a journal 117 and a groove 118.

Integrally formed on the yoke arm 6 is a conical bearing element 16 through which a bore 110 passes. The conical bearing element 18 is formed in the end wall 25 of the supporting element 5 by an integrally formed cone-like depression through it which a bore 111 also passes. The spring element 28 is of a U-shaped configuration, providing legs 113 and 114 having a cutout 115 to allow passage of the bearing pin 26 and another cutout 116 to fasten the leg 114 in the groove 118 of the bearing pin 26. FIG. 11 shows the bearing structure of FIG. 12 in the assembled state in which the conical bearing elements 16 and 18 are held in slidable relative engagement by means of the spring tension of the spring element 28 in conjunction with the bearing pin 26. The opposite lying pivot bearing is of identical construction.

FIG. 13 shows a view of the inside of the clipper comb 3 with the foil 47 and the chassis 48 fastened thereto, as well as with a locking device 10 arranged in the interior of the U-shaped chassis 48—see FIG. 3. The chassis 48 is shown in a partly broken away view to expose the components of the locking device 10 comprised of a spring element 107 resting against a wall 105 of the chassis chamber 106, and a locking element 108 acted upon by the spring element 107. With two hook-shaped resilient legs 96, 97 the locking element 108 is held under the spring action of the spring element 107 against two holding lugs 98 and 99 provided on the inner wall of the chassis chamber 106 and is arranged for movement in the direction of the wall 105 of the chassis chamber 106 in opposition to the pressure of the spring element 107.

Integrally formed on the locking element 108 is at least one latching element 78, 79 which, when latched with the supporting element 5, reaches behind at least one latching element 38, 39, thus effecting a releasable attachment of the clipper head S to the supporting element 5. The latching elements 78 and 79 are disengaged from the latching elements 38 and 39 by actuating the pushbuttons of the locking device 9 and 10 on which the latching elements 78 and 79 are provided—see FIG. 14—thus enabling the clipper head S to be taken off the supporting element 5.

We claim:

1. A power driven hair clipper, comprising a drive mechanism provided in a housing (1) and a clipper head (S) comprising a clipper comb (3) in cooperating relationship with first and second clipper blades (4, 82), said clipper head being mounted on said housing (1) for selectable pivotal motion about a pivot axis between at least first and second pivoted positions, whereby alternately one of said first and second clipper blades (4, 82) is coupled with said drive mechanism according to the selected respective pivoted position of the clipper head (S) relative the housing (1), and wherein the clipper head is supported on the housing by pivot bearings formed by cooperating bearing elements (16, 17, 18, 19) relatively movable against the pressure of at least one spring element (28, 29).

2. The hair clipper as claimed in claim 1, wherein the clipper head (S) is secured to a supporting element (5) mounted on the housing (1) for pivotal motion about the pivot axis.

3. The hair clipper as claimed in claim 2, wherein the supporting element (5) is constructed as a housing shell.

4. The hair clipper as claimed in claim 3, wherein an end of the housing (1) defines two opposing side wall, and the housing shell is pivotally mounted on the two opposing side walls of the housing (1).

5. The hair clipper as claimed in claim 3, wherein an end of the housing (1) defines a U-shaped yoke, and the housing shell is pivotally mounted on yoke arms (6, 7) of the housing (1) by pivot bearings.

6. The hair clipper as claimed in claim 1, wherein the cooperating bearing elements (16, 17, 18, 19) supporting the clipper head on the housing are formed by cooperating conical bearing elements.

7. The hair clipper as claimed in claim 6, wherein a bearing pin (26, 27) passes through the conical bearing.

8. The hair clipper as claimed in claim 7, wherein the bearing pin (26, 27) is movable against the pressure of said at least one spring element (28, 29).

9. A power driven hair clipper, comprising a drive mechanism provided in a housing (1) and a clipper head (S) comprising a clipper comb (3) in cooperating relationship with first and second clipper blades (4, 82), said clipper head being mounted on said housing (1) for selectable pivotal motion about a pivot axis between at least first and second pivoted positions, whereby alternately one of said first and second clipper blades (4, 82) is coupled with said drive mechanism according to the selected respective pivoted position of the clipper head (S) relative the housing (1), wherein the clipper head (S) is secured to a supporting element (5) mounted on the housing (1) for pivotal motion about the pivot axis, and wherein the clipper head (S) is releasably attached to the supporting element (5) by a locking device (9, 10).

10. A power driven hair clipper, comprising a drive mechanism provided in a housing (1) and a clipper head (S) comprising a clipper comb (3) in cooperating relationship with first and second clipper blades (4, 82), said clipper head being mounted on said housing (1) for selectable pivotal motion about a pivot axis between at least first and second pivoted positions, whereby alternately one of said first and second clipper blades (4, 82) is coupled with said drive mechanism according to the selected respective pivoted position of the clipper head (S) relative the housing (1), wherein the clipper comb (3) has two rows of cutting teeth (40, 41).

11. The hair clipper as claimed in claim 10, further comprising a chassis (48) fastened to the clipper comb.

12. The hair clipper as claimed in claim 11, wherein the chassis (48) is provided with at least one locking device (9, 10) having a latching element (78, 79) movable against the pressure of a latch spring element (107).

13. The hair clipper as claimed in claim 9, further comprising at least one latching element (38, 39) for the locking device (9, 10), said latching element being disposed on the supporting element (5).

14. The hair clipper as claimed in claim 1, wherein a pivot range of the clipper head (S) is limited by stops.

15. The hair clipper as claimed in claim 14, wherein said stops are formed by cooperating wall elements (90, 92; 91, 93) formed respectively on the clipper head and on the housing (1).

16. The hair clipper as claimed in claim 1, wherein a pivot range of the clipper head (S) is determined by a detent device (RV).

17. A power driven hair clipper, comprising a drive mechanism provided in a housing (1) and a clipper head (S) comprising a clipper comb (3) in cooperating relationship with first and second clipper blades (4, 82), said clipper head being mounted on said housing (1) for selectable pivotal motion about a pivot axis between at least first and second pivoted positions, whereby alternately one of said first and second clipper blades (4, 82) is coupled with said drive mechanism according to the selected respective pivoted position of the clipper head (S) relative the housing (1), wherein a pivot range of the clipper head (S) is determined by a detent device (RV), and wherein the detent device (RV) is formed by at least one notch (102) and one detent element (101) adapted to be biased by a detent spring element (100).

18. The hair clipper as claimed in claim 17, wherein the detent spring element (100) and the detent element (101) are provided in the housing, and the notch (102) is provided on an outer wall of the clipper head.

19. The hair clipper as claimed in claim 3, wherein the clipper head (S) with the housing shell of the supporting element (5) is pivotally mounted inside a housing head shell (20) of the housing (1) on a wall of the housing head shell (20).

20. The hair clipper as claimed in claim 1, wherein the clipper head is mounted by pivot bearings to the housing, and directions of extension of a wall of the housing (1) on either side of the pivot bearings are each aligned parallel to a maximal pivot angle of the clipper head (S).

21. The hair clipper as claimed in claim 20, wherein the pivot angles of the clipper head (S) on respective sides of the pivot bearings are of equal size.

22. The hair clipper as claimed in claim 20, wherein the pivot angles of the clipper head (S) on respective sides of the pivot bearings are of different size.

23. The hair clipper as claimed in claim 11, wherein the chassis (48) is disposed on a foil (47) which is disposed on the clipper comb (3).

24. The hair clipper as claimed in claim 23, wherein at least one clipper blade (4, 82) has a row of cutting teeth (42, 43), and an end portion of said at least one clipper blade spaced from said row of cutting teeth is in sliding contact with the foil (47).

25. The hair clipper as claimed in claim 23, wherein the foil (47) has a perforation.

26. The hair clipper as claimed in claim 25, wherein the perforation defines a receptacle for a lubricant.

27. The hair clipper as claimed in claim 25, wherein the perforation is defined by holes.

28. The hair clipper as claimed in claim 23, wherein the perforation is defined by flanges.

29. The hair clipper as claimed in claim 1, wherein the pivot axis extends lateral of the housing.

30. The hair clipper as claimed in claim 29, wherein the pivot axis extends generally parallel a longitudinal extent of at least one of the clipper blades.

31. A power driven hair clipper, comprising a drive mechanism provided in a housing (1), and a clipper head (S) comprising a clipper comb (3) in cooperating relationship with first and second moving clipper blades (4, 82), wherein the clipper comb has two rows of cutting teeth along opposing edges of the comb, the first clipper blade being in cooperating relationship to a first said row of comb teeth, the second clipper blade being in cooperating relationship to a second said row of comb teeth, said clipper head being mounted on said housing (1) for selectable displacement between at least first and second operating positions, whereby in said first operating position said first clipper blade (4) is coupled with said drive mechanism and said second clipper blade is decoupled from said drive mechanism, and in said second operating position said second clipper blade (82) is coupled with said drive mechanism and said first clipper blade is decoupled from said drive mechanism.

32. The hair clipper as claimed in claim 31, wherein the clipper head is mounted on said housing for pivotal motion about a pivot axis, said first and second operating positions corresponding to first and second pivoted positions.

33. The hair clipper as claimed in claim 32, wherein the pivot axis extends lateral of the housing.

34. The hair clipper as claimed in claim 32, wherein the pivot axis extends generally parallel a longitudinal extent of at least one of said clipper blades.

35. The hair clipper as claimed in claim 31, wherein the clipper head is latchable in either of said first and second operating positions.

36. A method of engaging one of a plurality of clipper blades of a power driven hair clipper selectively by a user, comprising the steps of providing a drive mechanism in a housing, and a clipper head comprising a clipper comb in cooperating relationship with first and second moving clipper blades, providing at least two rows of teeth on said clipper comb, said first row of comb teeth being in cooperating engagement with said first clipper blade and said second row of comb teeth being in cooperating engagement with said second clipper blade, mounting said clipper head for displacement on said housing, moving said clipper head relative the housing to a first operating position, coupling, in said first operating position, said first clipper blade with said drive mechanism and decoupling said second clipper blade from said drive mechanism, and then moving said clipper head relative the housing to a second operating position, decoupling, in said second operating position, said first clipper blade from said drive mechanism and coupling said second clipper blade with said drive mechanism, whereby a user can selectively choose said first and second operating positions.

37. The method of claim 36, wherein the clipper head is mounted on said housing for pivotal motion about a pivot axis, said first and second operating positions corresponding to first and second pivoted positions.

38. The method of claim 37, wherein the pivot axis extends lateral of the housing.

39. The method of claim 37, wherein the pivot axis extends generally parallel a longitudinal extent of at least one of said clipper blades.

40. The method of claim 36, further comprising the step of latching the the clipper head in either of said first and second operating positions.

41. The hair clipper as claimed in claim 17, wherein the detent spring element (100) and the detent element (101) are provided in the clipper head, and the notch (102) is provided in the housing.

42. The hair clipper as claimed in claim 11, herein the clipper head (S) is secured to a supporting element (5) mounted on the housing (1) for pivotal motion about the pivot axis, the clipper head (S) is releasably attached to the supporting element (5) by a locking device (9, 10), and the chassis (48) carries at least a portion of the locking device (9, 10).

43. The hair clipper as claimed in claim 10, wherein a first row of said comb cutting teeth is wider than a second row of said comb cutting teeth.

44. The hair clipper as claimed in claim 10, wherein a first row of said comb cutting teeth is constructed differently than a second row of said comb cutting teeth.

45. The hair clipper as claimed in claim 44, wherein the first row (41) of said comb cutting teeth has a greater pitch than the second row (40) of said comb cutting teeth.

46. The hair clipper as claimed in claim 31, wherein said first row of comb cutting teeth is wider than a second row of said comb cutting teeth.

47. The hair clipper as claimed in claim 31, wherein a first row of said comb cutting teeth is constructed differently than a second row of said comb cutting teeth.

48. The hair clipper as claimed in claim 47, wherein the first row (41) of said comb cutting teeth has a greater pitch than the second row (40) of said comb cutting teeth.

49. The method of claim 36, further comprising the step of providing said first row of comb cutting teeth wider than said second row of comb cutting teeth.

50. The method of claim 36, further comprising the step of constructing said first row of comb cutting teeth differently than said second row of comb cutting teeth.

51. The method of claim 50, wherein the first row (41) of comb cutting teeth is constructed having a greater pitch than the second row (40) of comb cutting teeth.

52. The hair clipper as claimed in claim 1, wherein the clipper comb (3) is formed in one piece.

53. The hair clipper as claimed in claim 10, wherein the clipper comb (3) is formed in one piece.

54. The hair clipper as claimed in claim 31, wherein the clipper comb (3) is formed in one piece.

55. The method of claim 36, wherein the clipper comb (3) is formed in one piece.

* * * * *